US011156047B2

(12) United States Patent
Shan et al.

(10) Patent No.: US 11,156,047 B2
(45) Date of Patent: Oct. 26, 2021

(54) WIRE ROPE CORING DRILLING RIG AND NEW GREEN CONSTRUCTION METHOD CAPABLE OF REPLACING TRENCH AND SHALLOW-SHAFT EXPLORATIONS

(71) Applicant: Heilongjiang Institute of Geological Sciences, Haierbin (CN)

(72) Inventors: Jiuku Shan, Haierbin (CN); Xiangxu Liu, Haierbin (CN); Lianguo Wang, Haierbin (CN); Guangjie Shan, Haierbin (CN); Dan Zhou, Haierbin (CN); Yongbo Pan, Haierbin (CN); Wenli Hao, Haierbin (CN); Zongmin Li, Haierbin (CN); Zhiyu Pei, Haierbin (CN); Yongtao Fu, Haierbin (CN)

(73) Assignee: Heilongjiang Institute of Geological Sciences, Haerbin (CN)

( * ) Notice: Subject to any disclaimer, the term of this patent is extended or adjusted under 35 U.S.C. 154(b) by 17 days.

(21) Appl. No.: 16/066,791

(22) PCT Filed: Nov. 17, 2017

(86) PCT No.: PCT/CN2017/111501
§ 371 (c)(1),
(2) Date: Dec. 13, 2018

(87) PCT Pub. No.: WO2018/090962
PCT Pub. Date: May 24, 2018

(65) Prior Publication Data

US 2019/0338610 A1 Nov. 7, 2019

(30) Foreign Application Priority Data

Nov. 18, 2016 (CN) ..... 201611033548.1

(51) Int. Cl.
*E21B 25/02* (2006.01)
*E21B 3/02* (2006.01)
(Continued)

(52) U.S. Cl.
CPC ..... *E21B 25/02* (2013.01); *E21B 3/02* (2013.01); *E21B 7/04* (2013.01); *E21B 15/04* (2013.01)

(58) Field of Classification Search
CPC ..... E21B 15/04; E21B 25/005; E21B 25/02; E21B 3/02; E21B 7/04; E21B 7/046
See application file for complete search history.

(56) References Cited

U.S. PATENT DOCUMENTS 4,466,497 A * 8/1984 Soinski ..... E21B 25/02 175/236
8,387,720 B1 * 3/2013 Keast ..... E21B 44/00 175/24

(Continued)

FOREIGN PATENT DOCUMENTS

CN 103775000 A 5/2014
CN 105329794 2/2016

(Continued)

OTHER PUBLICATIONS

International Search Report, State Intellectual Property Office of the P.R. China, dated Feb. 14, 2018.

*Primary Examiner* — Caroline N Butcher
(74) *Attorney, Agent, or Firm* — Bay State IP, LLC

(57) ABSTRACT

Certain aspects of the instant application are directed to a steel coring drilling machine and a method for replacing trench well exploration which can be applied in a large scale for horizontal drilling and exploring on the surface. The steel coring drilling machine includes a base, a main machine, a drilling tool, a drill rod and a steel coring system. The main machine is installed on the base, which is capable of (Continued)

adjusting the installation angle of the main machine, the drill rod is installed on the main machine, and the main machine is used to drive the rotation and feed of the drill rod. The front end of the drill rod is fixedly connected with the drilling tool. The back end of the drill rod is connected with the steel coring system. The axis of rotation of the drill tool is collinear with the axis of rotation of the drill rod.

9 Claims, 5 Drawing Sheets

(51) Int. Cl.
*E21B 7/04* (2006.01)
*E21B 15/04* (2006.01)

(56) References Cited

U.S. PATENT DOCUMENTS

| | | | | |
|---|---|---|---|---|
| 2002/0117336 | A1* | 8/2002 | Tremblay | E21B 7/027 175/122 |
| 2013/0192901 | A1* | 8/2013 | Iondov | E21B 25/02 175/247 |
| 2015/0204149 | A1* | 7/2015 | O'Reilly | E21B 47/024 175/45 |
| 2017/0081144 | A1* | 3/2017 | Upmeier | E21B 7/02 |

FOREIGN PATENT DOCUMENTS

| | | | |
|---|---|---|---|
| CN | 105649563 | | 6/2016 |
| CN | 105781462 | A | 7/2016 |
| CN | 205400642 | U | 7/2016 |
| CN | 106437582 | A | 2/2017 |
| CN | 206174903 | U | 5/2017 |

* cited by examiner

WIRE ROPE CORING DRILLING RIG AND NEW GREEN CONSTRUCTION METHOD CAPABLE OF REPLACING TRENCH AND SHALLOW-SHAFT EXPLORATIONS

CROSS REFERENCE TO RELATED APPLICATION

This application is for entry into the U.S. National Phase under § 371 for International Application No. PCT/CN2017/111501 having an international filing date of Nov. 17, 2017, and from which priority is claimed under all applicable sections of Title 35 of the United States Code including, but not limited to, Sections 120, 363, and 365(c), and which in turn claims priority under 35 USC 119 to Chinese Patent Application No. 201611033548.1 filed on Nov. 18, 2016.

TECHNICAL FIELD

The present invention relates to the field of exploration technology, and in particular, to a steel coring drilling machine and a green new construction method capable of replacing trench well exploration.

BACKGROUND

Geological trench exploration is one of the most commonly used methods for geological exploration. The method is to use manpower or machinery to excavate a long trench of 0.3 m which has a certain length and passes through the cover to reach the bedrock in a certain direction on the surface. The depth of the long trench is generally not more than 3 m, the width of the surface is generally measured by the depth of the trench at 1:1 of slopes, and rock samples are carved at the bedrock. Geological exploration or mineral anomaly inspection is then performed after the work such as catalog description and sample testing analysis from geology technicians.

Geological shallow well exploration is also one of the more commonly used methods for geological exploration. The method is to use manpower or machinery to excavate a circular or square shallow well on the surface and the depth is generally not more than 20 m. Rock samples are obtained after reaching the bedrock or designing rock stratum. Geological exploration or mineral anomaly inspection is then performed after the work such as catalog description and sample testing analysis from geology technicians.

Geological trenches and shallow wells are often collectively referred to as trench well exploration. At present, the main issues in trench exploration methods are as follows.

1. The most important issue for construction of trench wells in forest land and cultivated land is the destruction of forest land and cultivated land and destruction of the ecological environment. Even if backfilling and restoration of vegetation are carried out immediately after completion, environmental restoration will take from several years to several decades or longer.

2. In addition to the need to pay for its own construction fees, the trench well exploration construction needs to pay a large amount of expenses, such as land use fees, forest land and cultivated land occupation fees, tree young crops compensation fees, forest land and cultivated land recovery fees, etc., so that the exploration cost continues to increase.

3. There are safety risks in the construction of trench exploration. In recent years, there have been accidents of casualties resulted from the collapse of side slopes of trench well exploration.

4. When shallow wells are excavated, wood frames or other measures should be used to support according to the conditions of the stratum. When there is groundwater, drainage is required. The construction process is complicated, the construction difficulty and safety risks are relatively large and the cost is high.

5. It is difficult or impossible for the trench exploration to be constructed in areas with the covering layer of 3 m or more, and artificial judgment is needed for entering the bedrock. This will result in a relatively complete residual slope or a weathered layer that is mistaken for the bedrock. There is an issue of sampling in a wrong location, resulting in exploration errors.

In recent years, people have been investigating devices and methods that can replace geological trench well exploration. For example, many types of shallow bedrock drills have been used for testing and production, but none of them can replace trench well exploration. The main reasons are as follows.

1. Because the drilling machine is basically designed as exploration having a large angle of 90° or more than 45°, the horizontal projection of the obtained core is much smaller than the vertical projection, and the effect of replacing the trench well exploration cannot be achieved.

2. The surface exploration needs to be drilled in the shallow collapsed and fractured stratum. Generally, a drilling machine cannot guarantee normal operation in this stratum and cannot guarantee the coring rate.

3. The existing bedrock shallow drilling machines cannot be promoted and applied in a larger scale due to poor construction environment conditions, frequent site conversion, low efficiency, high cost and difficulty in construction.

SUMMARY

In order to solve the above problems, the present invention provides a steel coring drilling machine and a green new construction method capable of replacing trench well exploration, i.e., a construction method of horizontally drilling and exploring on the surface.

The present invention provides the following technical solutions:

a steel coring drilling machine, comprising a base, a main machine, a drilling tool, a drill rod and a steel coring system, wherein the main machine is installed on the base, the base is capable of adjusting the installation angle of the main machine, the drill rod is installed on the main machine, and the main machine is used to drive the rotation and feed of the drill rod, wherein the front end of the drill rod is fixedly connected with the drilling tool, the back end of the drill rod is connected with the steel coring system, the axis of rotation of the drill tool is collinear with the axis of rotation of the drill rod, and the main machine comprises:

a box-type feeding frame, which is installed on the base;

a power head base, which is provided on the box-type feeding frame;

a feeding cylinder, which is installed on the box-type feeding frame for driving the power head base to freely move along the length of the box-type feeding frame on the box-type feeding frame; and a power head, which is installed on the power head base and clamps the drill rod for driving the rotation of the drill rod.

Further, the power head comprises a hydraulic motor, a power head gearbox and a power head holder, wherein the power head gearbox is installed on the power head base, the hydraulic motor is installed on the power head gearbox and the output end of the hydraulic motor is in transmission connection with the input end of the power head gearbox, and the power head holder is installed on the power head gearbox and the power head holder is in transmission connection with an output end of the power head gearbox, and the power head holder is used to clamp the drill rod.

Further, the main machine further comprises a roller holder, wherein the roller holder is provided on the box-type feeding frame, and the roller holder clamps the drill rod and is used to rapidly advance or retract the drill rod.

Further, the base comprises a base steel beam, a base sleeper, a main machine supporting frame and a main machine installing frame, wherein the base sleeper is provided at the bottom of the base steel beam and is fixedly connected with the base steel beam through a screw, the bottom of the main machine supporting frame is hinged with the base steel beam, one of the main machine installing frames is provided on the base steel beam and the main machine supporting frame, respectively, the main machine installing frame on the base steel beam and the main machine installing frame on the main machine supporting frame jointly support the box-type feeding frame, and the main machine installing frame on the main machine installing frame is freely adjustable along the length of the main machine supporting frame.

Further, an installing hole is provided in the base sleeper, a steel chisel is installed in the installing hole, and the steel chisel is used to reinforce the base sleeper.

Further, the steel coring system comprises a winch, a strand conveyor, a strand guide tube and a drill rod joint, wherein the winch is wound with a steel strand, the strand conveyor is provided on the winch for conveying the steel strand, the strand conveyor is fixedly connected with the drill rod joint through the strand guide tube, the drill rod joint is connected to the back end of the drill rod, the steel strand passes sequentially through the strand guide tube and the drill rod joint into the drill rod under the driving of the strand conveyor, and one end of the steel strand extending into the drill rod is connected with an inner tube fishing head or an inner tube pusher.

Further, the steel coring drilling machine further comprises a power system, wherein the power system is connected to the main machine and the steel coring system, respectively, and the power system is used to drive the main machine to cause the motion of the drill rod and drive the steel coring of the steel coring system.

Further, the power system comprises a hydraulic device and a power machine, wherein the power machine is connected to the hydraulic device, and the power machine supplies oil to the main machine and the steel coring system by driving the hydraulic device to drive the motion of the main machine and the steel coring system;

the power machine comprises a diesel engine, a clutch and a diesel tank, wherein the diesel tank is connected with the diesel engine, and the output end of the diesel engine is in transmission connection with the hydraulic device through the clutch; and the hydraulic device comprises a hydraulic oil tank, a hydraulic oil pump, a hydraulic oil filter, and a hydraulic oil cooler, wherein the hydraulic oil pump is connected to the clutch, the hydraulic oil filter and the hydraulic oil cooler are provided on the hydraulic oil tank, and the hydraulic oil pump is in communication with the hydraulic oil tank through the hydraulic oil filter.

Further, the steel coring drilling machine further comprises an operation platform, wherein the power system is connected to the main machine and the steel coring system via the operation platform, respectively, and the operation platform is used to control the power system to supply oil to the main machine and the steel coring system;

the operation platform comprises an operation body, an instrument panel, an operating valve and a pipeline, wherein the instrument panel, the operating valve and the pipeline are provided on the operation body, respectively, the input end of the pipeline is in communication with the power system, the output end of the pipeline is in communication with the main machine and the steel coring system, respectively, the instrument panel is used to monitor oil parameters in the pipeline, and the operating valve is used to control the OF/OFF of the pipeline.

The present invention further provides a green new construction method capable of replacing trench well exploration, comprising the following steps:

S1: installing, wherein a base is fixed to the ground, a main machine is installed on the base, a drill rod is installed on the main machine, a drilling tool is installed on the front end of the drill rod, and the back end of the drill rod is installed together with the steel coring system;

S2: adjusting, wherein the installation angle of the main machine is adjusted through the base so that the drilling hole and the ground have an angle of 0-45°;

S3: drilling, wherein the main machine is controlled by the power system and the operation platform to drive the drill rod to cause the drilling tool to rotate and advance; and S4: coring, wherein a cyclic coring operation without lifting the drill is performed by the steel coring system.

The present invention provides a steel coring drilling machine and a green new construction method capable of replacing trench well exploration. The beneficial effect thereof is that the steel coring drilling machine can be used to achieve drilling of bedrocks horizontally or at a small angle on the surface to replace exploration of the trench well depending on earth excavation of a large area.

BRIEF DESCRIPTION OF THE DRAWINGS

The drawings used in the description of the embodiments or the prior art will be briefly described below in order to explain the embodiments of the present invention or the technical solutions in the prior art more clearly. It is apparent that the drawings in the following description are merely part of embodiments of the present invention. Other drawings may also be obtained by those of ordinary skill in the art based on these drawings without paying creative work.

Figure 1:
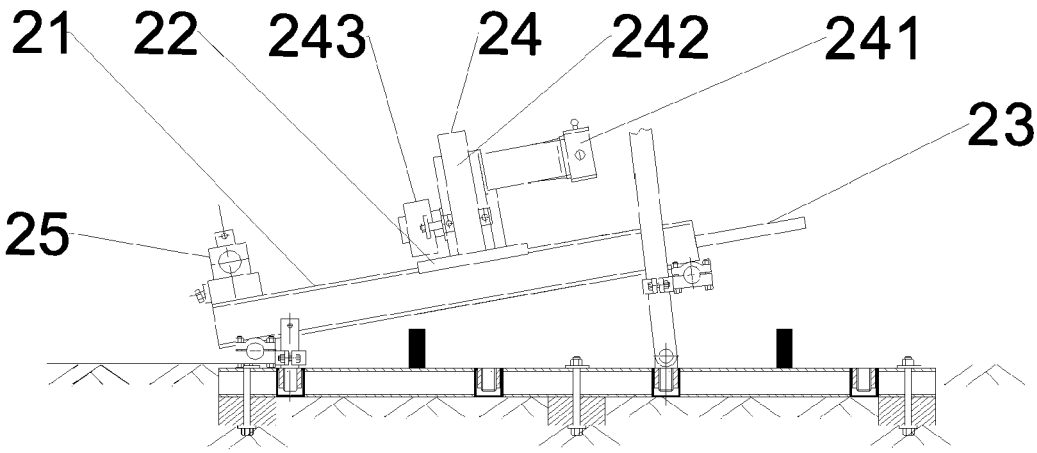
FIG. 1 is a schematic diagram illustrating the structure of a main machine of a steel coring drilling machine according to the present invention.
Figure 2:
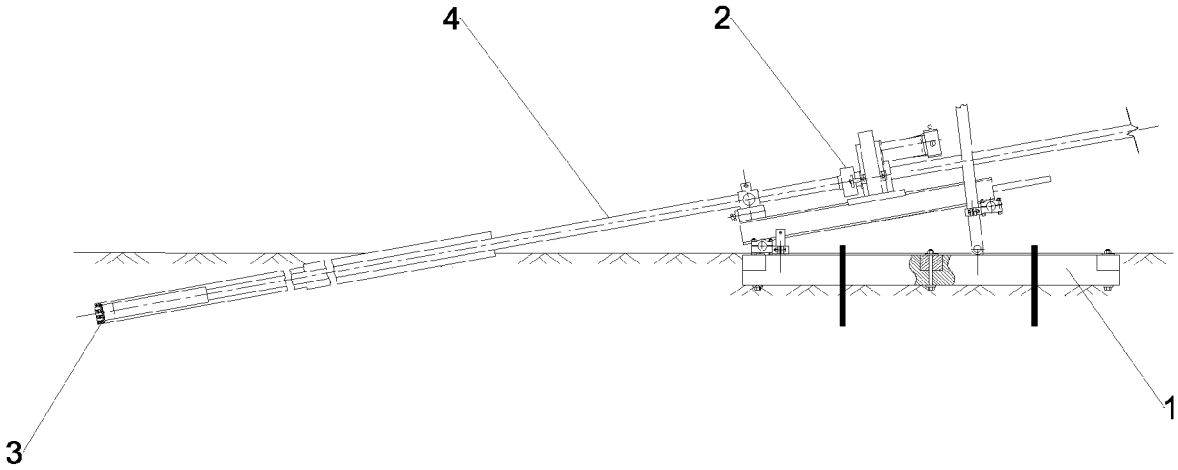
FIG. 2 is a schematic diagram illustrating the partial structure of a steel coring drilling machine according to the present invention.
Figure 3:
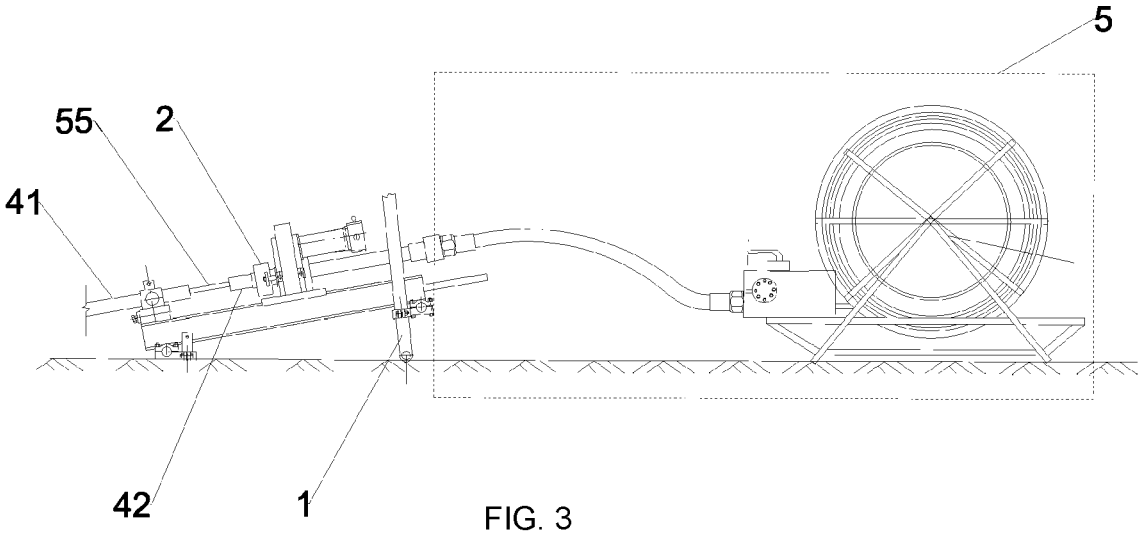
FIG. 3 is a schematic diagram illustrating the partial structure of a steel coring drilling machine according to the present invention.
Figure 4:
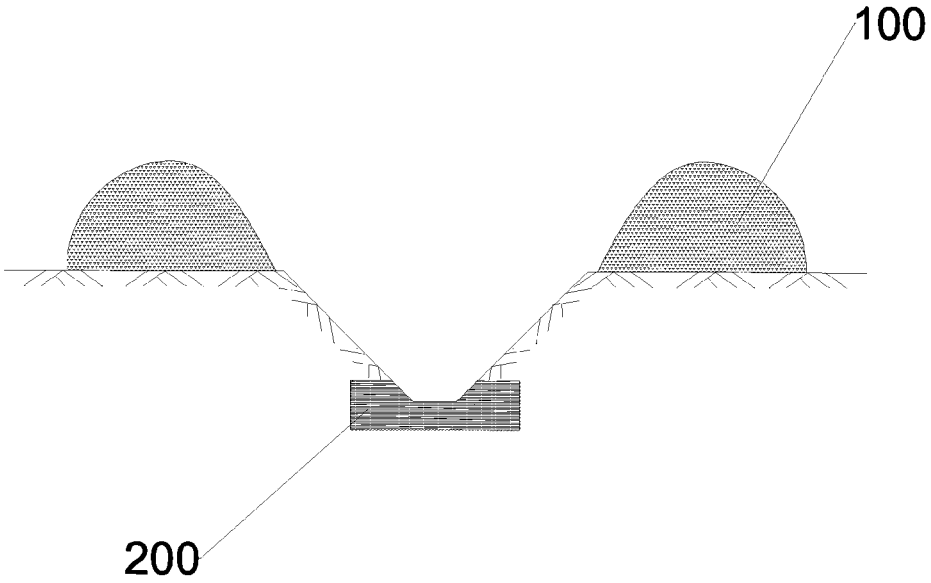
FIG. 4 is a diagram illustrating an exploring trench in the prior art.
Figure 5:
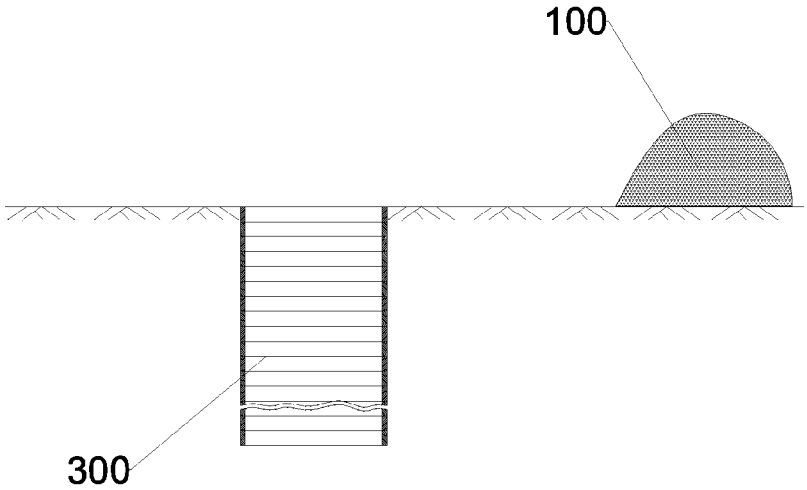
FIG. 5 is a sectional diagram illustrating a shallow well in the prior art.
Figure 6:
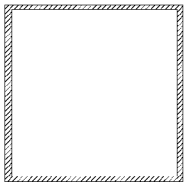
FIG. 6 is a plan diagram illustrating a shallow well in the prior art.

In the drawings, 1-base; 2-main machine; 3-drill; 4-drill rod; 5-steel coring system; 21-box-type feeding frame; 22-power head base; 23-feeding cylinder; 24-power head; 241-hydraulic motor; 242-power head gearbox; 243-power head holder; 25-roller holder; 11-base steel beam; 12-base sleeper; 13-main machine supporting frame; 14-main machine installing frame; 15-steel chisel; 51-winch; 52-strand conveyor; 53-strand guide tube; 54-drill rod joint; 55-steel strand; 56-inner tube fishing head; 57-inner tube pusher; 58-depth counter; 6-power system; 61-hydraulic device; 62-power machine; 621-diesel engine; 622-clutch; 623-diesel tank; 611-hydraulic oil tank; 612-hydraulic oil pump; 613-hydraulic oil filter; 614-hydraulic oil cooler; 7-operation platform; 71-operation body; 72-instrument panel; 73-operating valve; 74-pipeline; 41-inlet drill rod; 42-coring short drill rod; 8-inner tube mushroom head; 100-mound; 200-bedrock; 300-shallow well.

DESCRIPTION OF THE EMBODIMENTS

The technical solutions of the present invention will be described clearly below in order to make the objectives, technical solutions, and advantages of the present invention clearer. It is apparent that the described embodiments are merely part of embodiments of the present utility model rather than all embodiments. Other embodiments achieved by those of ordinary skill in the art based on the embodiments in the present invention without paying creative work shall all fall into the scope of protection of the present invention.

As shown in FIG. 1 to FIG. 6, a steel coring drilling machine comprises a base 1, a main machine 2, a drilling tool 3, a drill rod 4, and a steel coring system 5. The main machine 2 is installed on the base 1, the base 1 is capable of adjusting the installation angle of the main machine 2, the drill rod 4 is installed on the main machine 2, and the main machine 2 is used to drive the rotation and feed of the drill rod 4. The front end of the drill rod 4 is fixedly connected with the drilling tool 3, the back end of the drill rod 4 is connected with the steel coring system 5, and the axis of rotation of the drill tool 3 is collinear with the axis of rotation of the drill rod 4. The main machine 2 comprises: a box-type feeding frame 21, which is installed on the base 1; a power head base 22, which is provided on the box-type feeding frame 21; a feeding cylinder 23, which is installed on the box-type feeding frame 21 for driving the power head base 22 to freely move along the length of the box-type feeding frame 21 on the box-type feeding frame 21; and a power head 24, which is installed on the power head base 22 and clamps the drill rod 4 for driving the rotation of the drill rod 4. Through the above structure design, the steel coring drilling machine can be used to achieve drilling of bedrocks horizontally or at a small angle on the surface to replace exploration of the trench well depending on earth excavation of a large area.

In a preferred embodiment, the power head 24 comprises a hydraulic motor 241, a power head gearbox 242 and a power head holder 243. The power head gearbox 242 is installed on the power head base 22, the hydraulic motor 241 is installed on the power head gearbox 242 and the output end of the hydraulic motor 241 is in transmission connection with the input end of the power head gearbox 242, and the power head holder 243 is installed on the power head gearbox 242 and the power head holder 243 is in transmission connection with an output end of the power head gearbox 242, and the power head holder 243 is used to clamp the drill rod 4. The main machine 2 further comprises a roller holder 25, wherein the roller holder 25 is provided on the box-type feeding frame 21, and the roller holder 25 clamps the roller holder 4 and is used to rapidly advance or retract the drill rod 4. The respective components in the above main machine 2 cooperate with each other to realize the drilling, speed adjusting, clamping, lifting and feeding of the drill rod 4. Specifically, the components can include: a rotating drilling system of the main machine 2, a speed adjusting system of the main machine 2, a clamping system of the main machine 2, a lifting and feeding system of the main machine 2, and a rapid lifting and advancing system of the main machine 2, which are as follows.

1. The rotating drilling system of the main machine 2 mainly consists of a hydraulic motor 241, a power head gearbox 242, and a power head holder 243. The operating principle is that the hydraulic oil of a power car performs rotation drilling on the hydraulic motor 241, the power head gearbox 242 and the power head holder 243 clamping the drill rod 4 through the operating platform 7.

2. The speed adjusting system of the main machine 2 mainly consists of a hydraulic motor 241 and a power head gearbox 242. The operating principle is that the hydraulic oil of a power car achieves stepless speed adjusting rotation drilling on the hydraulic motor 241 and the power head gearbox 242 after passing through the system pressure adjustable operation platform 7.

3. The clamping system of the main machine 2 mainly consists of a power head holder 243 and a roller holder 25. The operating principle is that the hydraulic oil of a power car achieves the loosening and clamping of the drill rod 4 on the power head holder 243 and the roller holder 25 after passing through the system pressure adjustable operation platform 7, thereby realizing the operations, such as rotation, unscrewing, lifting and feeding, of the drill rod 4.

4. The lifting and feeding system of the main machine 2 mainly consists of a feeding cylinder 23, a power head base 22, a box-type feeding frame 21, and a power head holder 243. The operating principle is that the hydraulic oil of a power car is fed to the feeding cylinder 23 after passing through the system pressure adjustable operation platform 7 so as to drive the power head base 22 and the power head 24 connected thereto to move on the box-type feeding frame 21, thereby realizing the operations, such as lifting and feeding, of the drill rod 4.

5. The rapid lifting and advancing system of the main machine 2 mainly consists of a roller holder 25. The operating principle is that the hydraulic oil of a power car is fed to the roller rotating device of the roller holder 25 after passing through the system pressure adjustable operation platform 7 so that the roller clamping the drill rod 4 is rotated to push the drill rod 4 to advance or retract rapidly.

Figure 7:
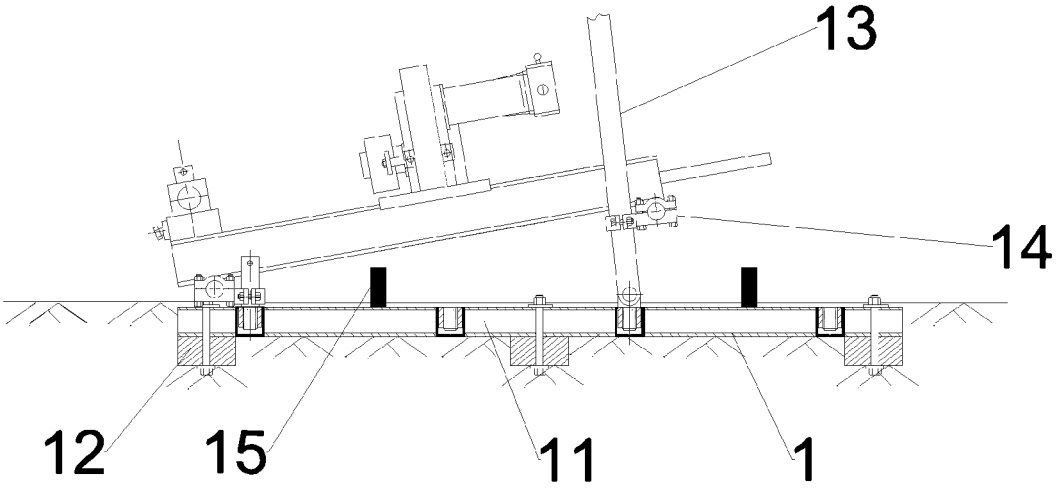
FIG. 7 is a schematic diagram illustrating a base of a steel coring drilling machine according to the present invention.

In a preferred embodiment, as shown in FIG. 7, the base 1 comprises: a base steel beam 11, a base sleeper 12, a main machine supporting frame 13 and a main machine installing frame 14. The base sleeper 12 is provided at the bottom of the base steel beam 11 and is fixedly connected with the base steel beam 11 through a screw, the bottom of the main machine supporting frame 13 is hinged with the base steel beam 11, one of the main machine installing frames 14 is provided on the base steel beam 11 and the main machine supporting frame 13, respectively, the main machine installing frame 14 on the base steel beam 11 and the main machine installing frame 14 on the main machine supporting frame 13 jointly support the box-type feeding frame 21, and the main machine installing frame 14 on the main machine installing frame 13 is freely adjustable along the length of the main machine supporting frame 13. An installing hole is provided in the base sleeper 12, a steel chisel 15 is installed in the installing hole, and the steel chisel 15 is used to reinforce the base sleeper 12.

In the above structure, the main installing and operating principle of the base 1 is as follows.

1. The installing system of the main machine 2 of the base 1 mainly consists of a base sleeper 12, a main machine installing frame 14, a main machine supporting frame 13, a base steel beam 11 and a fixing screw. The operating principle is that the main machine 2 is installed according to the design angle by the main machine installing frame 14, the main machine supporting frame 13 and the base steel beam 11, and the base steel beam 11 and the base sleeper 12 are installed and fixed into an integrity by a fixing screw.

2. The horizontal hole construction of the base 1 is completed by the main machine installing frame 14, the main machine supporting frame 13, and the base steel beam 11. The method is to disassemble the base steel beam 11 and transform it to another installing hole for installation. The displacement distance is 0.5-1 m.

3. The reverse hole construction of the base 1 is completed by the main machine installing frame 14, the main machine supporting frame 13, and the base steel beam 11. The method is to disassemble the base steel beam 11 and turn it around for installation.

4. The construction angle adjustment of the main machine 2 is completed by the main machine installing frame 14 and the main machine supporting frame 13. The method is to loosen fastening bolts on the main machine installing frame 14 and the main machine supporting frame 13, adjust the height of the main machine 2 on the main machine supporting frame 13, and tighten the fastening bolts on the installing frame and the supporting frame after a compass has measured the angle.

5. The stabilizing system of the base 1 mainly consists of a base sleeper 12, a base steel beam 11, a fixed screw, and a fixed a steel chisel 15. The operating principle is to make the base sleeper 12 completely buried in the foundation when flattening the ground, completely fasten and fix the base sleeper 12 and the base steel beam 11 into an integrity by the fixing screw, and then further reinforce by knocking the steel chisel 15 in the installing hole of the steel chisel 15 of the base sleeper 12.

Figure 8:
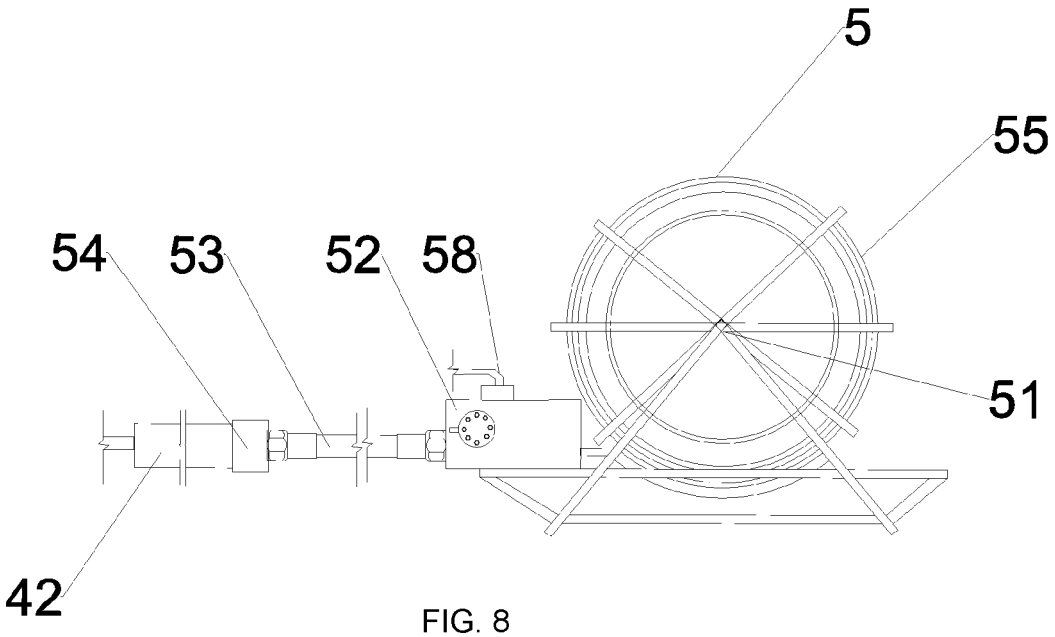
FIG. 8 is a schematic diagram illustrating the structure of a steel coring system of a steel coring drilling machine according to the present invention.
Figure 9:
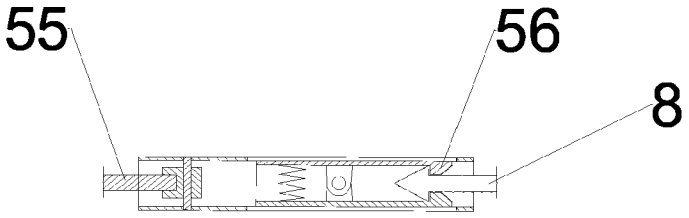
FIG. 9 is a schematic diagram illustrating the structure in which an inlet of a steel coring system of a steel coring drilling machine according to the present invention fishes an inner tube to core.
Figure 10:
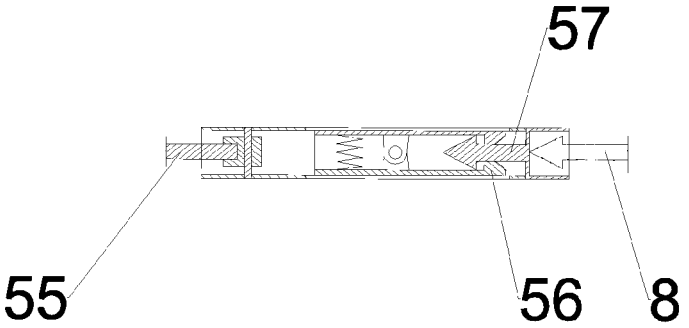
FIG. 10 is a schematic diagram illustrating the structure in which an inlet of a steel coring system of a steel coring drilling machine according to the present invention pushes an inner tube in place.

In a preferred embodiment, as shown in FIG. 8 to FIG. 10, the steel coring system 5 comprises: a winch 51, a strand conveyor 52, a strand guide tube 53, and a drill rod joint 54. The winch 51 is wound with a steel strand 55, the strand conveyor 52 is provided on the winch 51 for conveying the steel strand 55, the strand conveyor 52 is fixedly connected with the drill rod joint 54 through the strand guide tube 53, the drill rod joint 54 is connected to the back end of the drill rod 4, the steel strand 55 passes sequentially through the strand guide tube 53 and the drill rod joint 54 into the drill rod 4 under the driving of the strand conveyor 52, and one end of the steel strand 55 extending into the drill rod 4 is connected with an inner tube fishing head 56 or an inner tube pusher 57.

In the above structure, the main operating principle of the steel coring system 5 is that the steel coring system 5 mainly feeds the inner tube fishing head 56 and the inner tube pusher 57 to the inner hole coring inner tube or takes the inner tube fishing head 56 and the inner tube pusher 57 out of the inner hole coring inner tube with the use of the strand conveyor 52 through the steel strand 55, the strand guiding tube 53, the drill rod joint 54 and the drill rod 4 so as to complete the coring cycle of the inner tube. The winch 51 can store and automatically roll the steel strand 55, and the steel coring system 5 also has a depth counter 58 which can display the rolling meters of the steel strand 55 at any time. The drill rod 4 includes a coring short drill rod 42 and an inlet drill rod 41, and the distance between the coring short drill rod 42 and the inlet drill rod 41 is 200 mm The main operating processes of the steel coring system 5 are as follows.

1. The inner tube is lifted for coring: first, the steel strand 55 and the inner tube fishing head 56 associated therewith (it needs to be removed if the inner tube fishing head 56 is connected with the inner tube pusher 57) are fed into the inner hole of the inlet drill rod 41 through the through-hole in the power head 24, and then the coring short drill rod 42 sleeved outside of the steel strand 55 and connected with the strand guide tube 53 and the drill rod joint 54 is inserted into the inner through-hole of the power head 24 and is clamped. The interval between the coring short drill rod 42 and the drill rod 41 is adjusted to be about 200 mm so as to observe the operation condition of the steel strand 55. The operating valve 73 feeds the oil to the strand conveyor 52 through the operation platform 7 so that the steel strand 55 is brought into the hole with the inner tube fishing head 56. After the inner tube fishing head 56 reaches the bottom of the hole and is clamped with the mushroom head 8 of the inner tube, the inner tube fishing head is lifted out by the strand conveyor 52 and stops from being lifted out when the inner tube reaches the interval of 200 mm The inner tube fishing head 56 and the power head holder 243 are released, the coring short drill rod 42 is taken out of the power head 24, and the inner tube is taken out manually so as to complete the coring operation of the inner tube.

2. The inner tube is pushed: first, the inner tube is manually fed into the inner hole of the inlet drill rod 41. After being connected with a pusher, the inner tube fishing head 56 becomes the inner tube pusher 57, and then is fed into the inner hole of the inlet drill rod 41 through the through-hole in the power head 24 by the steel strand 55 and the inner tube fishing head 56 associated therewith, and then the coring short drill rod 42 sleeved outside of the steel strand 55 and connected with the strand guide tube 53 and the drill rod joint 54 is inserted into the inner through-hole of the power head 24 and is clamped. The interval between the coring short drill rod 42 and the drill rod 41 is adjusted to be about 200 mm so as to observe the operation condition of the steel strand 55. The operating valve 73 feeds the oil to the strand conveyor 52 through the operation platform 7 so that the steel strand 55 is brought into the hole with the inner tube pusher 57 to push the inner tube forward. After the inner tube pusher 57 reaches the bottom of the hole and pushes and clamps the inner tube into the outer tube, the inner tube pusher 57 is withdrawn by the strand conveyor 52 and stops when the inner tube pusher 57 reaches the interval of 200 mm The power head holder 243 is released, and the coring short drill rod 42 is taken out of the power head 24 so as to complete the operation of pushing the inner tube.

Figure 11:
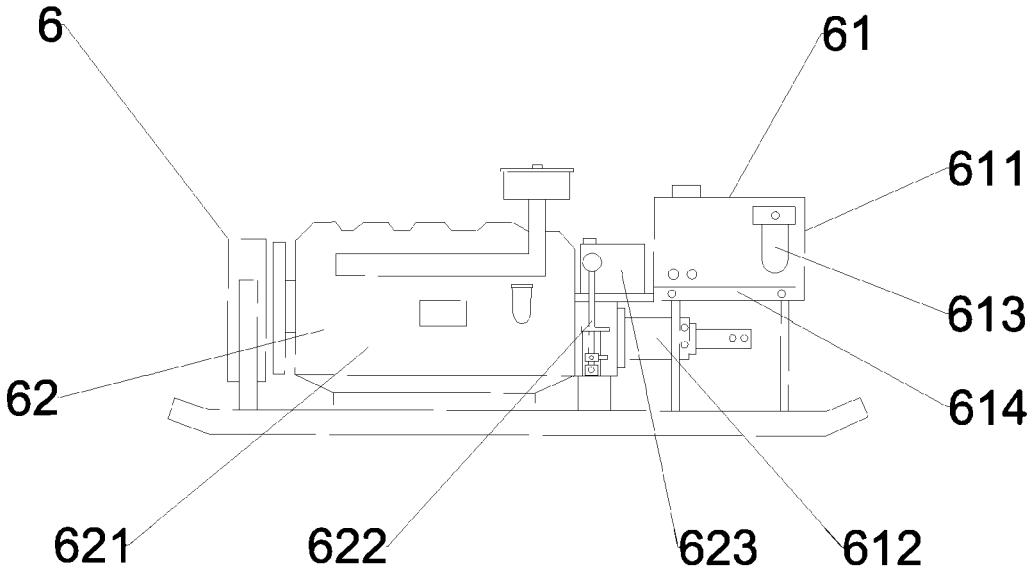
FIG. 11 is a schematic diagram illustrating the structure of a power system of a steel coring drilling machine according to the present invention.

In a preferred embodiment, as shown in FIG. 11, the steel coring drilling machine further comprises a power system 6. The power system 6 is connected to the main machine 2 and the steel coring system 5, respectively, and the power system 6 is used to drive the main machine 2 to cause the motion of the drill rod 4 and drive the steel coring of the steel coring system 5. The power system 6 comprises a hydraulic device 61 and a power machine 62, wherein the power machine 62 is connected to the hydraulic device 61, and the power machine 62 supplies oil to the main machine 2 and the steel coring system 5 by driving the hydraulic device 61 to drive the motion of the main machine 2 and the steel coring system 5; the power machine 62 comprises a diesel engine 621, a clutch 622 and a diesel tank 623, wherein the diesel tank 623 is connected with the diesel engine 621, and the output end of the diesel engine 621 is in transmission connection with the hydraulic device 61 through the clutch 622; and the hydraulic device 61 comprises a hydraulic oil tank 611, a hydraulic oil pump 612, a hydraulic oil filter 613, and a hydraulic oil cooler 614, wherein the hydraulic oil pump 612 is connected to the clutch 622, the hydraulic oil filter 613 and the hydraulic oil cooler 614 are provided on the hydraulic oil tank 611, and the hydraulic oil pump 612 is in communication with the hydraulic oil tank 611 through the hydraulic oil filter 613.

In the above structure, the power system 6 mainly comprises the hydraulic device 61 and the power machine 62. The main operating principle is as follows.

The operating principle of the hydraulic device 61 is that the diesel engine 621 rotates the hydraulic oil pump 612 through the clutch 622, the hydraulic oil is output to the control device of the operation platform 7 and is distributed to various actuators by the control device after entering the hydraulic oil pump 612 from the hydraulic oil tank 611 and the hydraulic oil filter 613. The cooling device of the hydraulic oil is cooled by the return water after being connected to the hydraulic oil cooler 614 of the oil tank by a return pipe of a mud pump of the drilling machine, which has the efficacy of good cooling effect and saving power.

The operating principle of the power machine 62 is that the diesel tank 623 supplies oil, the diesel engine 621 is operated, and power is output through the clutch 622.

Figure 12:
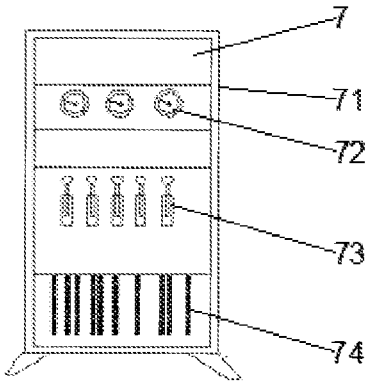
FIG. 12 is a schematic diagram illustrating the structure of an operation platform of a steel coring drilling machine according to the present invention.

In a preferred embodiment, as shown in FIG. 12, the steel coring drilling machine further comprises an operation platform 7. The power system 6 is connected to the main machine 2 and the steel coring system 5 via the operation platform 7, respectively, and the operation platform 7 is used to control the power system 6 to supply oil to the main machine 2 and the steel coring system 5; the operation platform 7 comprises an operation body 71, an instrument panel 72, an operating valve 73 and a pipeline 74, wherein the instrument panel 72, the operating valve 73 and the pipeline 74 are provided on the operation body 71, respectively, the input end of the pipeline 74 is in communication with the power system 6, the output end of the pipeline 74 is in communication with the main machine 2 and the steel coring system 5, respectively, the instrument panel 72 is used to monitor oil parameters in the pipeline 74, and the operating valve 73 is used to control the OF/OFF of the pipeline 74.

In the above structure, the operating principle of the operation platform 7 is that the operating hydraulic oil input by the power car is input and output to the various execution systems through the operating valve and the pipeline 74 to perform various operations of the drilling machine, and various instruments on the instrument panel 72 on the operation body 71 indicate the status of various system parameters at any time.

The present invention further provides a green new construction method capable of replacing trench well exploration, i.e., a construction method of horizontally drilling and exploring on the surface, comprising the following steps:

S1: installing, wherein a base 1 is fixed to the ground, a main machine 2 is installed on the base 1, a drill rod 4 is installed on the main machine 2, a drilling tool 3 is installed on the front end of the drill rod 4, and the back end of the drill rod 4 is installed together with the steel coring system 5;

S2: adjusting, wherein the installation angle of the main machine 2 is adjusted through the base 1 so that the drilling hole and the ground have an angle of 0-45°;

S3: drilling, wherein the main machine 2 is controlled by the power system 6 and the operation platform 7 to drive the drill rod 4 to cause the drilling tool 3 to rotate and advance; and S4: coring, wherein a cyclic coring operation without lifting the drill is performed by the steel coring system 5.

The operating principle of the above construction method is that drilling is performed in a horizontal direction through a main machine 2 of a full hydraulic coring drilling machine, a drill rod 4 and a double-pipe drilling tool 3 with a bit installed on the base 1 of a drilling machine on the surface to rotate and drill in a horizontal direction. The angle of the drilling hole is horizontal or a small angle (generally 0-45°). The depth may be determined according to the geological design and drilling machine capacity. After entering the bedrock, the cores start to be continuously extracted, and then geological exploration or mineral anomaly inspection is then performed after the work such as catalog description and sample testing analysis from geology technicians.

The features and advantages of the above exploration construction method are as follows.

1. The problems of protection of forest land and cultivated land are fundamentally solved and the contradiction between environmental protection and mineral exploration at the current stage is solved.

2. A comparative study of a large number of field experiments shows that social and economic benefits are very significant.

Taking the forest area as an example, a horizontal drilling machine site of an exploration construction method provided by the present invention temporarily occupies an area of about 31 $m^2$ and a deforestation area of about 16 $m^2$. Taking the horizontal drilling of 100 m as an example, a site of 100 m is drilled in one direction, and is drilled in a forward direction and a reverse direction up to 200 m; corresponding to trenches of 200 extended meters (the depth of the trench is calculated as 3 m at 1:1 of slopes), the deforestation area is (200 extended meters×6.6 meters wide)=1320 $m^2$, both sides of the trench have mound of about 5 m in width and of about (200 extended meters×5 meters wide×2 sides) 200 $m^2$ in occupied area. Therefore, the deforestation area of the exploration construction method is about 1/83 of the trench, and the temporarily occupied area is 1/65 of the trench, greatly reducing the deforestation area for exploration.

3. The exploration construction method of the present invention can greatly reduce a large amount of expenses, land use fees, forest land and cultivated land occupation fees, tree young crops compensation fees, forest land and cultivated land recovery fees, etc., so that the actual cost of exploration is limitedly increased.

4. The exploration construction method of the present invention is to pass through the covering layer into the bedrock for construction and continuously coring, improving the accuracy and effect of geological exploration. After the field is compared with the constructed trench, its advantages are as follows.

(1) Horizontal drilling has obvious advantages in the division of the stratigraphic boundary. It can clearly and accurately divide the lithologic boundary, and can continuously and clearly observe the mineralized alteration and zonation of rocks.

(2) Horizontal drilling in the deep bedrock position can better avoid the effect of weathering of the surface bedrock on observing the mineralized alteration, and greatly increase the possibility of discovering mineralized bodies.

(3) In areas where the residual slope of the surface layer is thicker and the bedrock cannot be exposed by artificial excavation or mechanical excavation, drilling and exploration in the horizontal direction can more accurately determine the lithologic boundary and better observe the phenomenon of mineralized alteration. The possibility of losing or breaking mines is reduced.

(4) For shallow geophysical and geochemical exploration anomalies on the surface, the existing trench exploration methods cannot achieve the geological purpose, and in the case that the theoretical basis for vertical drilling is not enough, shallow geological conditions and shallow geophysical exploration anomalies can be verified using horizontal drilling in the early period, and the advantage of horizontal drilling is obvious.

(5) For the near-vertical mineralized body that has been discovered, horizontal drilling can more accurately determine the horizontal width of the mineralized body and match the vertical drilling to accurately obtain mineral resource reserves.

In summary, the present invention provides a steel coring drilling machine and a green new construction method capable of replacing trench well exploration. Its main features and technical breakthroughs are as follows.

1. The development of the steel coring drilling machine in which drilling of trench well exploration in the horizontal direction on the surface is replaced with drilling has filled the gap in the field of the coring drill in the horizontal direction on the surface in China.

2. The steel coring drilling machine in which drilling of trench well exploration in the horizontal direction on the surface is replaced with drilling has basically achieved the light, applicable, efficient and appropriately moderate technical and economical parameters and indicators having some functions so as to basically achieve the promotion and use requirements in terms of efficiency, cost and quality.

3. The main features of the base design of the steel coring drilling machine in which drilling of trench well exploration in the horizontal direction on the surface is replaced with drilling are as follows.

(1) The base of the drilling machine basically consists of five sleepers, two drilling machine base steel beams, a front set of and a back set of angle-adjustable drilling machine supporting frames, and four fixed steel chisels. The structure is simple, firm and reliable.

(2) The drilling machine base 1 on one site can realize four-way porous drilling, which can reduce the occupied area, reduce the number of relocations, increase the efficiency and reduce the cost, and can also meet the needs of obtaining the occurrence of the geological rock stratum.

The same-direction porous drilling is performed in such a way that the base steel beam is translated by 0.5-1 m on the base sleeper and the drilling angle can be changed. The stratum occurrence of the geological rock stratum is obtained through the change of the depth and position of the rock marker layer. Reverse drilling is accomplished by turning around the drilling machine through the base steel beam.

(3) Stabilization of drilling machines is the basic condition for ensuring normal drilling of drilling machines. The base adopts a drilling machine stabilizing system in which "the base 1 is embedded in the ground and driven into the steel chisel for reinforcement", basically meeting the construction requirements. There are no problems such as sinking, displacement, and tilting.

4. The main features and technical breakthroughs of the steel coring system (1) In order to ensure that the coring of the stratum is not disturbed, the coring accuracy is increased, and the core volume and the coring rate are guaranteed, drilling in the horizontal direction on the surface should give priority to the current most common drilling process method, i.e., rope coring drilling.

Rope coring is widely used due to its high efficiency, low cost, high coring rate, low bending rate of drilling holes, and low labor intensity of workers, but the normal rope coring is put into the inner tube by its own weight, and the rope winch 51 takes out the inner tube and the core through a steel wire rope and a fisher. The drilling angle is generally required to be greater than 45° to be used, so the rope coring cannot be performed when the surface is drilled at 0-45°. If the inner tube is further advanced and extracted by an adapter tube, the sense of rope coring is lost to some extent. The horizontal drilling of the bedrock is constructed on the shallow layer of the collapsed and broken surface. A general drilling method cannot guarantee the coring rate. The main breakthrough of this system is to replace the steel wire rope with a steel strand 55 for coring, which fundamentally solves the obstacle that the rope drilling cannot be used for the drilling at 0-45°. The steel coring steel strand 55 has some strength in addition to the bendability, which can complete the work of fishing and advancing the coring tube.

(2) The steel coring system greatly reduces the frequency of lifting the drill. A hole having a depth of 100 m has a basic number of lifting the drill of about 1-3 times, so that the borehole wall is more stable. The collapsed stratum can shorten the roundtrip meterage and guarantee the coring rate, and has truly achieved the effects of high automation, high efficiency, high accuracy, low cost, easy operation, and easy maintenance.

The above description is only the specific embodiment of the present invention, but the scope of protection of the present invention is not limited thereto. Any changes or the replacements conceivable to those skilled in the art within the technical scope disclosed by the present invention should fall within the scope of protection of the present invention. Therefore, the scope of protection of the present invention shall be subject to the scope of protection of the claims.

What is claimed is:

1. A steel coring drilling machine, comprising: a base fixed to a ground, a main machine, a drilling tool, a drill rod and a steel coring system, wherein the main machine is installed on the base, the base is capable of adjusting an installation angle of the main machine, the drill rod is installed on the main machine, and the main machine is used to drive the rotation and feed of the drill rod, wherein the front end of the drill rod is fixedly connected with the drilling tool, the back end of the drill rod is connected with the steel coring system, an axis of rotation of the drill tool is collinear with an axis of rotation of the drill rod, and the main machine comprises:

a box-type feeding frame, which is installed on the base;

a power head base, which is provided on the box-type feeding frame;

a feeding cylinder, which is installed on the box-type feeding frame for driving the power head base to freely move along the length of the box-type feeding frame;

a power head, which is installed on the power head base and clamps the drill rod for driving the rotation of the drill rod;

wherein the drilling tool performs horizontally through the main machine, wherein the drill rod and the drilling tool rotate and drill in a horizontal direction at an angle of between zero and forty-five degrees between a drilling hole and the ground;

wherein the base further comprises a base steel beam, a plurality of base sleepers, a main machine supporting frame and a first and a second main machine installing frames, wherein the base sleepers are provided at the bottom of the base steel beam and are fixedly connected with the base steel beam through a number of screws and extend along a length of the drilling machine, the bottom of the main machine supporting frame is hinged with the base steel beam, the first main machine installing frame is attached on the base steel beam and the second main machine installing frame is attached on the main machine supporting frame, respectively, the main machine installing frame on the base steel beam and the main machine installing frame on the main machine supporting frame jointly support the box-type feeding frame, and the main machine installing frame on the main machine supporting frame is freely adjustable along the length of the main machine supporting frame.

2. The steel coring drilling machine according to claim 1, wherein the power head comprises a hydraulic motor, a power head gearbox and a power head holder, wherein the power head gearbox is installed on the power head base, the hydraulic motor is installed on the power head gearbox and an output end of the hydraulic motor is in transmission connection with an input end of the power head gearbox, and the power head holder is installed on the power head gearbox and the power head holder is in transmission connection with an output end of the power head gearbox, and the power head holder is used to clamp the drill rod.

3. The steel coring drilling machine according to claim 2, wherein the main machine further comprises a roller holder, wherein the roller holder is provided on the box-type feeding frame, and the roller holder clamps the drill rod and is used to rapidly advance or retract the drill rod.

4. The steel coring drilling machine according to claim 1, wherein an installing hole is provided in the base sleeper, a steel chisel is installed in the installing hole, and the steel chisel is used to reinforce the base sleeper.

5. The steel coring drilling machine according to claim 1, wherein the steel coring system comprises a winch, a strand conveyor, a strand guide tube and a drill rod joint, wherein the winch is wound with a steel strand, the strand conveyor is provided on the winch for conveying the steel strand, the strand conveyor is fixedly connected with the drill rod joint through the strand guide tube, the drill rod joint is connected to the back end of the drill rod, the steel strand passes sequentially through the strand guide tube and the drill rod joint into the drill rod under the driving of the strand conveyor, and one end of the steel strand extending into the drill rod is connected with an inner tube fishing head or an inner tube pusher.

6. The steel coring drilling machine according to claim 1, further comprising a power system, wherein the power system is connected to the main machine and the steel coring system, respectively, and the power system is used to drive the main machine to cause the motion of the drill rod and drive the steel coring of the steel coring system.

7. The steel coring drilling machine according to claim 6, wherein the power system comprises a hydraulic device and a power machine, wherein the power machine is connected to the hydraulic device, and the power machine supplies oil to the main machine and the steel coring system by driving the hydraulic device to drive the motion of the main machine and the steel coring system;

the power machine comprises a diesel engine, a clutch and a diesel tank, wherein the diesel tank is connected with the diesel engine, and the output end of the diesel engine is in transmission connection with the hydraulic device through the clutch; and the hydraulic device comprises a hydraulic oil tank, a hydraulic oil pump, a hydraulic oil filter, and a hydraulic oil cooler, wherein the hydraulic oil pump is connected to the clutch, the hydraulic oil filter and the hydraulic oil cooler are provided on the hydraulic oil tank, and the hydraulic oil pump is in communication with the hydraulic oil tank through the hydraulic oil filter.

8. The steel coring drilling machine according to claim 7, further comprising an operation platform, wherein the power system is connected to the main machine and the steel coring system via the operation platform, respectively, and the operation platform is used to control the power system to supply oil to the main machine and the steel coring system;

the operation platform comprises an operation body, an instrument panel, an operating valve and a pipeline, wherein the instrument panel, the operating valve and the pipeline are provided on the operation body, respectively, the input end of the pipeline is in communication with the power system, the output end of the pipeline is in communication with the main machine and the steel coring system, respectively, the instrument panel is used to monitor oil parameters in the pipeline, and the operating valve is used to control the OF/OFF of the pipeline.

9. A method capable of replacing trench well exploration using the steel coring drilling machine according to claim 1, comprising the following steps:

S1: installing, wherein a base is fixed to the ground, a main machine is installed on the base, a drill rod is installed on the main machine, a drilling tool is installed on the front end of the drill rod, and the back end of the drill rod is installed together with the steel coring system;

S2: adjusting, wherein the installation angle of the main machine is adjusted through the base so that the angle between the drilling hole and the ground have an angle of 0-45°;

S3: drilling, wherein the main machine is controlled by a power system and an operation platform to drive the drill rod to cause the drilling tool to rotate and advance; and S4: coring, wherein a cyclic coring operation without lifting the drill is performed by the steel coring system.

* * * * *